US005272772A

United States Patent [19]

Hahn

[11] Patent Number: 5,272,772

[45] Date of Patent: Dec. 28, 1993

[54] ADJUSTABLE CAP

[76] Inventor: Hubert C. Hahn, 19 Winding La., Bloomfield, N.J. 07003

[21] Appl. No.: 28,548

[22] Filed: Mar. 8, 1993

Related U.S. Application Data

[63] Continuation-in-part of Ser. No. 937,645, Aug. 31, 1992.

[51] Int. Cl.[5] ..... A42B 1/22

[52] U.S. Cl. ..... 2/195.2; 2/418; 24/580

[58] Field of Search ..... 2/181, 181.2, 181.4, 2/181.8, 183, 197, 417, 418, 420; 24/580, 581

[56] References Cited

U.S. PATENT DOCUMENTS

| | | | |
|---|---|---|---|
| 1,593,452 | 7/1926 | Hertzman | 2/197 |
| 2,536,146 | 1/1951 | Wiese | 24/580 |
| 3,495,306 | 2/1970 | Eichberg | 24/580 |
| 3,682,163 | 8/1972 | Plummer | 24/580 |
| 3,992,720 | 11/1976 | Nicolinas | 2/418 |
| 4,872,218 | 10/1989 | Holt | 2/197 |
| 4,999,846 | 3/1991 | Ball | 2/417 |

*Primary Examiner*—Clifford D. Crowder
*Assistant Examiner*—Diana L. Biefeld

[57] ABSTRACT

An adjustable head cap comprises a multi-gored portion having a lower brim, a visor, and adjustable means for adjusting the circumferential size of the cap. The adjustment means comprises a first strap member having a plurality of protruding studs (male members) and a second strap member having a plurality of spaced apart apertures (female members) wherein the female members are formed as a series of inclined hook-like members for improved interlocking engagement of the two strap members.

1 Claim, 1 Drawing Sheet

ADJUSTABLE CAP

RELATED APPLICATION

This application is a continuation-in-part of application Ser. No. 07/937,645 filed Aug. 31, 1992.

FIELD OF THE INVENTION

This invention relates in general to a cap structure, and more particularly to a cap structure which is adjustable to fit a variety of head sizes. In one of its more specific aspects, this invention relates to an adjustable baseball-type cap having an improved rim portion with a unique adjustable snap member adapted to expand or reduce the cap size so as to adapt it to the head sizes of different wearers.

BACKGROUND OF THE INVENTION

A variety of caps and baseball-type caps have been available and several such caps have been described in numerous patents. For example, U.S. Pat. No. 4,662,007 discloses a baseball-type cap structure for multi-size utilization wherein the cap includes a shell forming the crown portion, a visor and ear flaps which are hingedly secured to the base of the shell. The crown portion is formed of several gore portions; non-stretchable gores fastened to the visor portion with the remainder gores being stretchable to provide size adjustment.

Another cap disclosed in U.S. Pat. No. 4,644,588 comprises an eyeshield for infants. This cap includes a stretchable crown portion and a stretchable hem extending from the lower edge of the crown. An opaque insert on the hem covers the eyes of the infant during phototherapy treatment. The stretchable hem portion is attached to the crown portion by overedge seam type stretching so that the stretchability of the fabric is not restricted.

Another adjustable cap is disclosed in an early patent, i.e., U.S. Pat. No. 1,501,654. The cap disclosed in said patent comprises a body portion having one or more openings or notches along its lower edge, and one or more constricting straps which can be adjusted to vary the size of the cap.

An adjustable sweatband for headgear is disclosed in U.S. Pat. No. 4,481,681. This sweatband is used for uniform caps and comprises a casing with one open end and one closed end and a strap extending through and beyond the open end of the casing, said strap having a free end and a stationery end, with spaced locking means provided on said free end adapted to snap into spaced tabs on the stationery end. The circumference of the sweatband may be varied and adjusted by snapping the locking means into a different tab to thereby increase or decrease the circumference of the sweatband.

The elastic caps which have heretofore been employed have not been entirely satisfactory. These caps, after a period of wear, become uncomfortable due to constant pressure which the cap exerts on the head of the wearer. Frequently, the cap loses its elasticity after a period of wear and no longer fits the head of the wearer. On the other hand, caps with adjustable means have been in use for some time. These caps comprise an adjustable means usually formed within the interior lower rim of the cap, and a cutout portion usually formed in the back or sides of the crown portion. The cutout portions are provided to enable spaced apart points on the lower rim of the crown to be brought together when adjustment is needed to fit a smaller head. These cutout portions can often be unattractive since they disrupt the continuity of the contour lines of the cap crown, and reveal the adjustment means. Also, bringing the spaced apart portion of the cutout together as aforesaid causes crimping and buckling of crown material surrounding the cutout portion.

It is therefore an object of the present invention to provide an adjustable baseball-type cap which is free from the foregoing deficiencies.

It is a further object of this invention to provide a cap structure which comprises an adjustment means for varying the cap size to fit the head sizes of different wearers without the discomfort or disfigurements experienced with the prior art caps.

It is still another object of this invention to provide such adjustable caps which are simple and economical to construct, attractive to wear, and which exhibit the necessary structural integrity.

The foregoing objects and other features of this invention will be more fully appreciated from the ensuing detailed description and the accompanying drawings of the invention which constitute part of this application.

SUMMARY OF THE INVENTION

The present invention provides a cap structure having an adjustment means in order to adapt the cap to fit different head sizes. The cap comprises a multi-gored crown portion with a lower circumferential brim, a visor attached to the front gores by stretching or otherwise and an insert member secured to the brim having an adjustment means for adjusting the circumferential size of the cap. The adjustment means comprises a first strap member and a second strap member. The first strap member has a plurality of spaced apart protruding studs (male members). The second strap member has a plurality of spaced apart apertures (female members) adapted to be lockingly engage by the respective male members.

In a preferred embodiment the female members are formed as a series of inclined hook-like members in order to provide improved interlocking actions between the strap members during adjustment of the cap size.

BRIEF DESCRIPTION OF THE DRAWINGS

In the drawings, wherein like reference numerals designate like parts.

DESCRIPTION OF THE INVENTION

Figure 1:
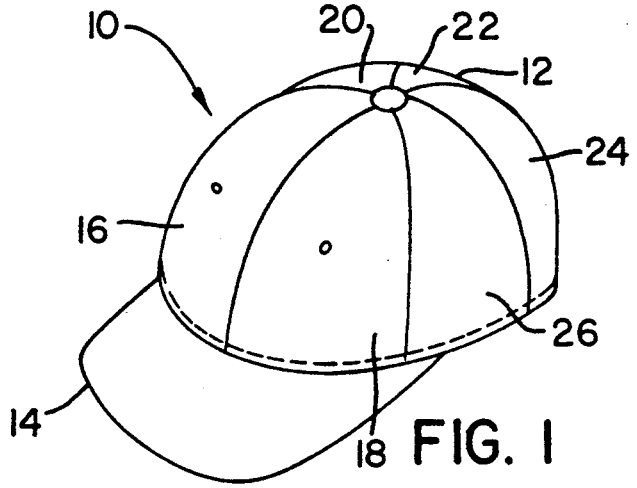
FIG. 1 is a perspective view of a baseball cap made in accordance with the present invention.
Figure 2:
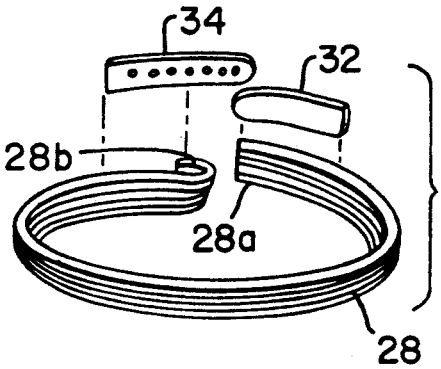
FIG. 2 is an exploded perspective view of the sweatband which is formed in the brim of the cap, showing the fastening means used to adjust the cap size.
Figure 3:
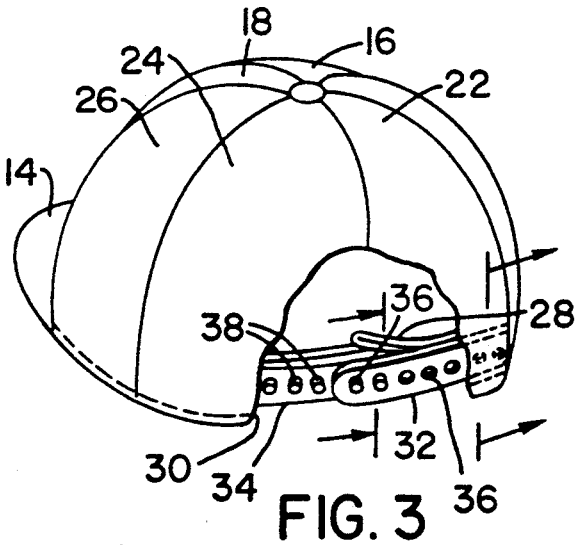
FIG. 3 is perspective rear view of the cap, partly broken away to show the fastening means in locking position.
Figure 4:
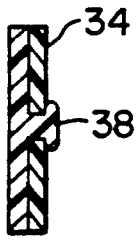
FIG. 4 is a vertical section taken along the line 4—4 of FIG. 3.
Figure 5:
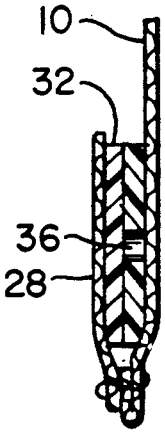
FIG. 5 is a vertical section taken along the line 5—5 of FIG. 3.

Referring first to FIGS. 1 and 2, a baseball-type cap generally designated by 10 comprises a crown portion 12 and a visor portion 14. The crown portion 12 is formed of a plurality of gores; non-stretchable gores 16 and 18 and stretchable gores 20, 22, 24 and 26. The non-stretchable gores 16 and 18 are made of a suitable fabric which is stiff, or stiffened by a rigid foam. For example, a foam material may be stitched to each gore 16, 18, or adhered thereto for a rigid or semi-rigid combination. Alternatively, the fabric may be chemically treated to impart stiffness and rigidly thereto in order to insure against deformation of the gores 16 and 18 which could otherwise detract from the appearance of the cap.

The visor 14 is normally rigid and hence it is not stretchable so as to avoid disfigurement or deformation.

The stretchable gores 20, 22, 24 and 26 are conveniently fabricated from a stretchable fabric which usually stretch in the peripheral direction. The selection of the fabric used to form the stretchable and non-stretchable gores and the formation of the crown portion 12 from such gores are generally within the skill of the art as shown, for example, in the aforementioned U.S. Pat. No. 4,622,007.

A sweatband 28 made of an elastic material is stitched or otherwise suitably affixed within the brim 30 of the crown portion 12 of the cap. The ends 28*a* and 28*b* of the sweatband preferably overlap one another and the end 28*b* may be curled as shown in FIG. 2. A pair of semi-rigid straps 32 and 34 are stitched or otherwise fastened at the ends of the sweatband 28 in overlapping relationship to one another. The strap 32 comprises a series of circumferentially disposed female members or apertures 36, with each aperture being spaced apart from the other a finite distance, usually ¼ inch to permit variation in cap size as hereinafter described. The semi-rigid strap 34 comprises a series of circumferentially spaced male members or studs 38 projecting from its outer surface wherein each stud is adapted to engage in a corresponding aperture (or female member) 38 to thereby provide locking engagement between the straps 32 and 34.

When the cap is to be worn, the strap 32 is manipulated to the left or right so that the aperture corresponding to the correct or comfortable head size lockingly engage a corresponding stud member on the strap 34. In this manner, the brim 30 is expanded or contracted circumferentially so that the cap will fit the head size of the wearer.

Figure 6:
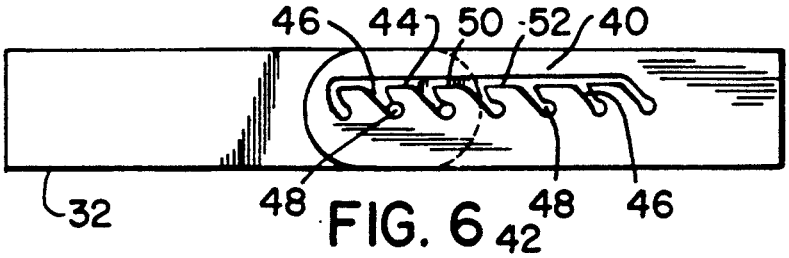
FIG. 6 is an enlarged view of the female portion of the fastening means according to a different embodiment of the invention.

A preferred embodiment of the invention, with respect to the fastening means is shown in FIG. 6. The strap 32 in FIG. 6 comprises, as portions of an integral flat strap, an elongated upper band 40 and an opposed parallel lower band 42. Protruding from the inside surface of the lower band 42 are a series of hook-like members 44 spaced apart in relation to one another. Between each successive hook-like member 44 is a generally inclined hollow portion 46 which terminate, at the lower ridge 42 in a generally round head opening 48. Each hook member 44 has a finger-like member 50 with a top flat surface 52. All the surfaces 52 are in the same plane and define an elongated channel (gap) 54 through which the stud 38 may be manipulated.

In the embodiment shown in FIG. 6 the strap 34 need only have one or two protruding studs 38.

In order to adjust the size of the cap, the strap 32 is manipulated so that the stud 38 lockingly engages into a round head opening 48 (female portion). In order to vary the size, the stud 38 is passed through the channel 54 and manipulated into the next round head opening 48 and so on until the desired size is achieved.

What is claimed is:

1. A cap structure adapted to fit different head sizes comprising:

(a) a multi-gored crown portion having a lower brim portion, (b) a visor, (c) an insert member secured to said brim, said insert member having an adjustable means for adjusting the circumferential size of said cap; adjustable means comprises a first strap member having an inner surface and an opposed parallel outer surface visible from the rear of said cap, said outer surface having at least one male member protruding from said surface, and said second member having an inner elongated upper surface and a lower parallel surface; a plurality of hook-like female members formed between said lower surface and said upper surface, said hook-like female members, having a top finger-like member having a flat surface wherein the top of said finger-like members define a channel with said upper surface, and a plurality of inclined hollow portions defined between said hook-like female members adapted to lockingly engage any one of said male members.

* * * * *